United States Patent [19]

Girault

[11] 4,116,011

[45] Sep. 26, 1978

[54] METHOD OF EXCAVATING TUNNELS

[76] Inventor: Pablo Girault, Volcan 120, Mexico City, Mexico, 10

[21] Appl. No.: 803,310

[22] Filed: Jun. 3, 1977

[30] Foreign Application Priority Data

Jun. 4, 1976 [MX] Mexico ..... 164996

[51] Int. Cl.[2] ..... E21D 11/10

[52] U.S. Cl. ..... 405/134; 134/147

[58] Field of Search ..... 61/43, 42, 45 R, 84, 61/63, 105, 85, 41, 727

[56] References Cited

U.S. PATENT DOCUMENTS

| | | | |
|---|---|---|---|
| 1,896,439 | 2/1933 | Dunlop | 61/42 X |
| 1,948,707 | 2/1934 | Gilman | 61/84 X |
| 2,208,302 | 7/1940 | Fernandez | 61/45 R |
| 3,413,812 | 12/1968 | Fox | 61/45 R |
| 4,041,713 | 8/1977 | Iwamitsu | 61/42 |

OTHER PUBLICATIONS

Engineering-News-Record, Jun. 2, 1960, pp. 36, 37, 38 and 40.

*Primary Examiner*—Jacob Shapiro

*Attorney, Agent, or Firm*—Imirie, Smiley & Guay

[57] ABSTRACT

A method of excavating tunnels comprises digging an excavation to form a tunnel, gradually pushing a casing inwardly of the excavation as the excavation proceeds, the cross-sectional area of the excavation being larger than the outer cross-sectional area of the casing in order to provide a hollow annular chamber between the same; arranging at least a seal at the inner end of the casing to seal the annular section between said casing and the excavation; arranging a seal at the entrance of the excavation to seal the annular section between the casing and the entrance to the excavation; and injecting under pressure a drilling mud to completely fill the annular space between the casing and the excavation as the excavation front advances, in order to provide a fluid support for the walls of the excavation and to float the casing within the excavation, whereby friction contact between said casing and the excavation is prevented as the casing is pushed inwardly of the excavation. The excavation front is preferably worked within an end chamber to which drilling mud is also injected to avoid leakage of the drilling mud from the annular space between the casing and the excavation and to permit removal of the excavating material suspended in the drilling mud, by pumping out the same.

6 Claims, 9 Drawing Figures

METHOD OF EXCAVATING TUNNELS

FIELD OF THE INVENTION

The present invention refers to an improved method of excavating tunnels wherein friction stresses between the casing and the walls of the excavation are avoided and, more particularly, it is related to an improved method of excavating tunnels by the so called casing or tube pushing system, wherein the pushed-in casing is floated in a drilling mud within the excavation to avoid friction and to provide a fluid support for the walls of the excavation.

BACKGROUND OF THE INVENTION

It is well known that for building tunnels, particularly when the excavation of the tunnel is to be effected in soft soils which walls are not self supporting and must be provided with a casing during excavation, and still more particular when excavating through non cohesive soils or sands both above or below subsurface water and through muddy soils or soft clays of any type, as well as soils formed by gravel or boulders, excavation methods are used in which a casing or supporting tube is arranged within the excavation in order to prevent collapsing of the walls of the tunnel, inasmuch as the latter are not self supporting.

A vast plurality of methods to accomplish the above have been deviced and are very well known in the art. Some typical processes comprise, inter alia, the provision of pneumatic chambers and the use of compressed air to fill the excavation and avoid collapsing thereof, but the above so called pressure systems have not gained popularity because they are unsafe, costly and require the use of highly sophisticated equipment. Other typical and more widely used processes are those using the so called "push-casing" systems, wherein a casing is arranged to be pushed by means of jacks or the like, with its outer surface in direct contact with the excavation and with the application of a suitable lubricating agent to facilitate displacement of the casing by reducing the friction between the outer surface of the casing and the surface of the excavation.

As lubricating agents for the above purpose, bentonite paste type lubricants are generally used, but these lubricants are simply applied in very thin layers between the sliding parts, which merely serve to avoid as much as possible the friction stresses, but without achieving the goal of reducing friction forces to an extent suitable to enable pushing inwardly of the excavation large lengths of casing or large diameter casings.

Therefore, prior art processes, particularly those which are effected by pushing a casing inwardly of the excavation, have not been adequate to permit insertion of a casing having a length or a diameter sufficiently large and, therefore, such excavation methods are restricted to relatively small tunnels, inasmuch as the pushing forces become excessively large when the length or the diameter of the excavation are large.

In view of the above, for excavating tunnels of considerable length or diameter, the pushing method has proven to be quite impractical, whereby other processes for supporting the walls of the excavation must be used, with the consequent increase in the costs of operation. The fact that the most economical method presently known for excavating tunnels, that is, the push-casing method, is impractical for excavating large tunnels, represents a serious drawback in the tunnel excavating art, but the fact is that said push-casing methods have not been sufficiently developed to reduce the friction forces between the casing and the walls of the excavation to an extent sufficient to permit pushing a large casing inwardly of said excavation.

Therefore, for long a process has been sought that, having the economical characteristics and advantages of the push-casing method, may also provide for the possibility of easily pushing large casings inwardly of straight or curved excavations, without the need of having resort to other costly methods for supporting the walls of the excavation.

BRIEF SUMMARY OF THE INVENTION

Having in mind the defects of the prior art tunnel excavation methods, it is an object of the present invention to provide a method of excavating tunnels by the use of the push-casing system, which will reduce in a practically complete manner the friction forces generated between the outer surface of the pushed-in casing and the surface of the excavation and thus will permit excavating tunnels having considerable length and diameter.

It is another object of the present invention to provide a method of excavating tunnels, of the above mentioned character, which will be of simple execution and entail considerable economies, and which however will be highly efficient for excavating curved or straight tunnels of considerable length.

A still more particular object of the present invention is to provide a method of excavating tunnels, of the above mentioned character, which will overcome all the problems of the prior art methods and will permit pushing very long and large casings into the excavation without generating excessive friction forces throughout the length of the excavation.

A more particular object of the present invention is to provide a method of excavating tunnels, of the above mentioned characteristics, which will permit placing of the final casing in a simple and economical manner, without the need of introducing special machinery and equipment in the tunnel.

A still further object of the present invention is to provide a method of excavating tunnels, of the above described character, which will permit the prefabrication of all the members utilized for assemblying the casing sections, will permit the fabrication of said casing in a factory and will allow a thorough inspection of said casing.

A still further object of the present invention is to provide a method of excavating tunnels, of the above specified character, which will prevent collapsing of the soil throughout the length of the tunnel as the excavation proceeds.

Another and more particular object of the present invention is to provide a method of excavating tunnels, of the above characteristics, which will permit floating of the casing in a fluid within the excavation and will provide for a leakproof sealing of the chamber containing such fluid.

A still other object of the present invention is to provide a method of excavating tunnels, of the above mentioned character, which will prevent water leakage into the excavation and will therefore avoid the necessity of pumping out subsurface water.

The foregoing objects and other ancillary thereto are preferably accomplished as follows:

A tunnel is excavated starting from a well or a portal, by any suitable method known in the art, such that the cross-sectional area of the excavation be slightly larger than the outer cross-sectional area of the casing to be pushed inwardly of the excavation, in order to permit the insertion of the casing into the excavation leaving an annular chamber between the casing and the excavation, thereafter filling said annular chamber with a drilling mud under a suitable pressure, to thereby effectively support the walls of the excavation and at the same time float the casing pushed into the excavation, whereby excessive friction forces throughout the tunnel will be prevented. In order to prevent leakage of drilling mud from the annular chamber between the excavation and the casing, at least one seal is provided at the outer end or entrance of the excavation between the walls of the excavation and the outer walls of the casing, and at least a further seal is provided at the inner end of the casing whereby to form a drilling mud containing chamber which may be maintained at a constant pressure to suitably support the walls of the excavation and float the casing. The casing may be maintained in a centered position spaced from the walls of the excavation by means of adjustable supports which generally only add minimum friction forces, inasmuch as the casing is actually floating in the drilling mud which is injected under pressure into the annular space or chamber between the excavation and the casing.

BRIEF DESCRIPTION OF THE DRAWINGS

The novel features that are considered characteristic of the present invention are set forth with particularity in the appended claims. The invention itself, however, both as to its organization and its method of operation, together with additional objects and advantages thereof, will best be understood from the following description of specific embodiments, when read in connection with the accompanying drawings, in which:

DETAILED DESCRIPTION

Figure 1:
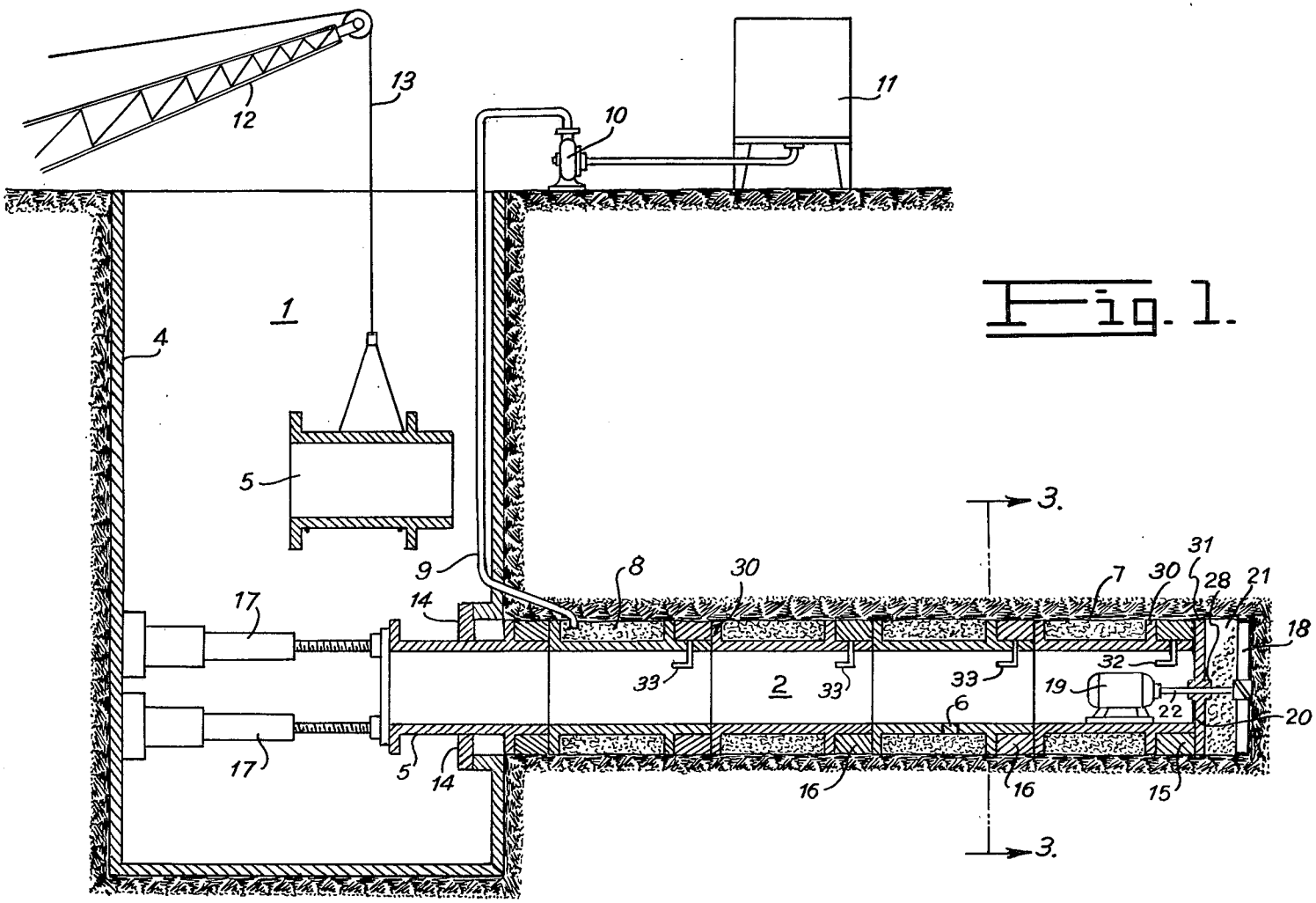
FIG. 1 is a diagrammatic cross-sectional elevational view of a tunnel excavation which is initiated from a well and wherein the method of the present invention is used.

The improved tunnel excavation method in accordance with the present invention permits an economical excavation of tunnels having any practical diameter and through any type of soil, particularly through soft soils which walls are not self supporting and therefore need the introduction of a casing during the excavation process. This method is particularly useful in non cohesive soils or sands, both above or below the sub-surface water. It is also highly useful for muddy soils or soft clays, as well as for gravels and boulders and it may even be used to excavate through rocky soils of any type, as well as through intermediate soils, for reducing subsidence. The method in accordance with the present invention also finds application in tunnels drilled through soft altered rock or medium quality rock as well as in cemented soils or in healthy rock, wherein it is applied merely as a method of inserting the casing in place.

The method in accordance with the present invention comprises initiating the excavation of a tunnel 2 from a well 1 of from a portal as is well known in the art. Well 1, as is clearly shown in the particularly preferred embodiment of FIG. 1 of the drawings, is vertically excavated through soil 3 and to said well the usual casing 4 is applied in accordance with well known techniques. The excavation front of tunnel 2 may be worked by any type of well known machinery or also by hand. However, in the embodiment illustrated in FIG. 1 of the drawings, said excavation method is effected using a machine in accordance with what will be described in more detail hereinafter, but it must be understood that this embodiment is not restrictive of the scope and spirit of the present invention. The excavation of the tunnel is effected by giving the tunnel a diameter slightly larger than the outer diameter of the casing, with the purpose of leaving an annular space 8 around casing 6 which is pushed inwardly of the excavation 2, so as to space a casing 6, which may be prefabricated from concrete or steel, from the soil 7. In order to prevent this empty space 8 to be occupied by the loose soil, inasmuch as the latter is not self-supporting, a drilling mud or any other fluid is injected thereinto, which injection is commenced as soon as practicable after the excavation itself is initiated.

The mud used in accordance with the present invention may be any type of mud such as that used for drilling wells, as well as muds containing barite, attapulgite, cement, bentonite, clays of any type and it may also contain additives to form better lattices in order to control the viscocity or in order to control leakage. The mud injection may be made at one or more points of the annular chamber 8 by means of pipes which may run within or outside the well but, in the illustrative embodiment represented in FIG. 1, the drilling mud is injected through pipe 9 which may be installed at the entrance of the excavation 2 but which may also be distributed into several pipes along the lenght of the tunnel, said pipe being able to run within or outside the casing 6, and the mud being pumped in by means of a pump 10 which takes the drilling mud from a suitable deposit 11.

The drilling mud is injected into chamber 8 under a suitable pressure which may be maintained by means of a column contained in a vertical pipe within the well or aside the same, as well as by varying its density. The pressure may also be maintained by means of the pump 10 itself, by a pressurized deposit, or by any other suitable means, without any of these means representing restriction in connection with the present invention.

The casing 6 is introduced concentrically along the tunnel excavation 2 and is generally formed by tube sections 5 which may be selected from steel sections, in which case the joints may be welded, and prefabricated concrete tube sections, in which case the joints may be effected by the provision of tensors or by any other known means. Tube sections 5 are lowered into the well 1 by means of a suitable crane 12 suspended from a cable 13 in accordance with what is illustrated in FIG. 1 of the drawings, and the complete casing 6 is pushed inwardly of the excavation 2 by means of a plurality of jacks 17, bearing on the opposite wall of the well or on a suitable structure.

In order to form a pressure chamber 8 for the drilling mud, at least a seal 14 is provided at the entrance of the excavation 21, that is, at the well 1 and at least one other seal 15 is provided at the inner end of the casing 6, whereby a leakproof chamber 8 is formed to contain the mud under pressure and such that the said pressure may be controlled to balance the vertical forces extant in the soil at the roof of the tunnel and, therefore, the horizontal forces as well, said pressure being able to be modified during the excavation operation in accordance with the movements observed in the walls of the excavation.

In accordance with the particular preferred embodiment of the invention illustrated in FIG. 1 of the drawings, several additional intermediate seals 16 may be distributed along the length of the excavation 2 for the purpose of forming annular chambers for containing pressurized mud, in order to enable the pressurization of said mud under different pressures and thus to provide test chambers to periodically test the mud for leakage and the like or in order to provide for the minimum possible detrimental effect of said leakage. As is well known in the art, when mud leakage exists, agents for controlling the loss of water are injected through suitable bores left or made through the walls of the casing.

Figure 2:
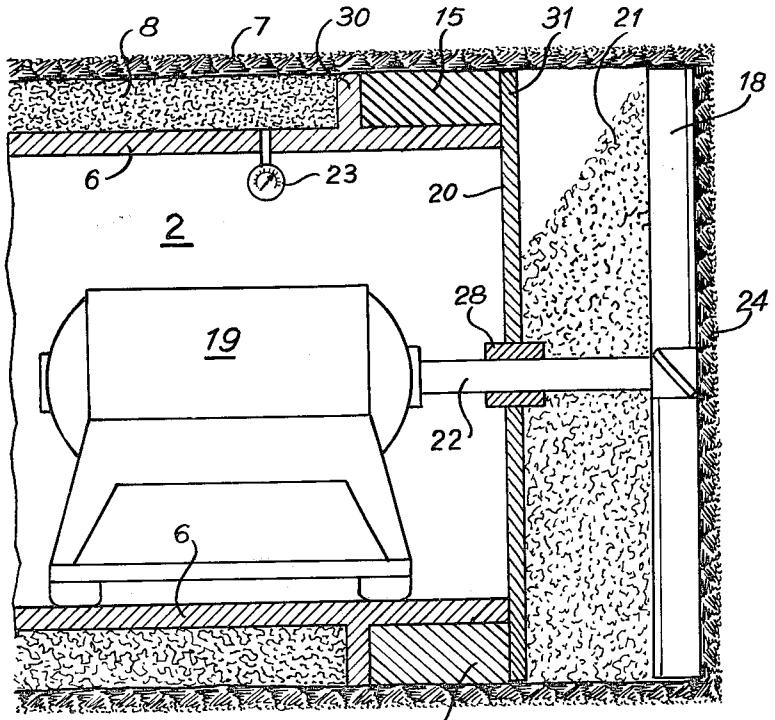
FIG. 2 is a diagrammatic fragmentary cross-sectional elevational view of the excavation front of the tunnel, showing the excavation apparatus and its relation with the tunnel and casing.
Figure 5:
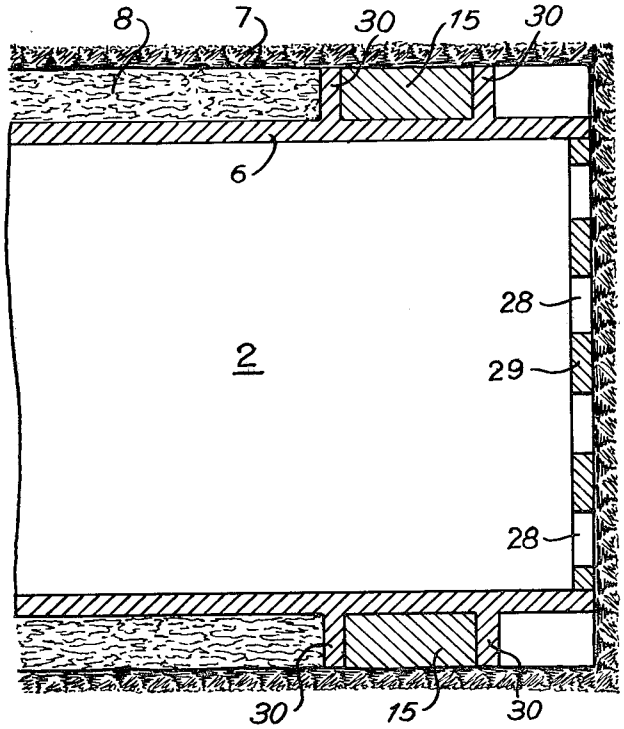
FIG. 5 is a view similar to FIG. 4 but showing the excavating front provided with a perforate plate through which the excavating material is removed from the excavation
Figure 4:
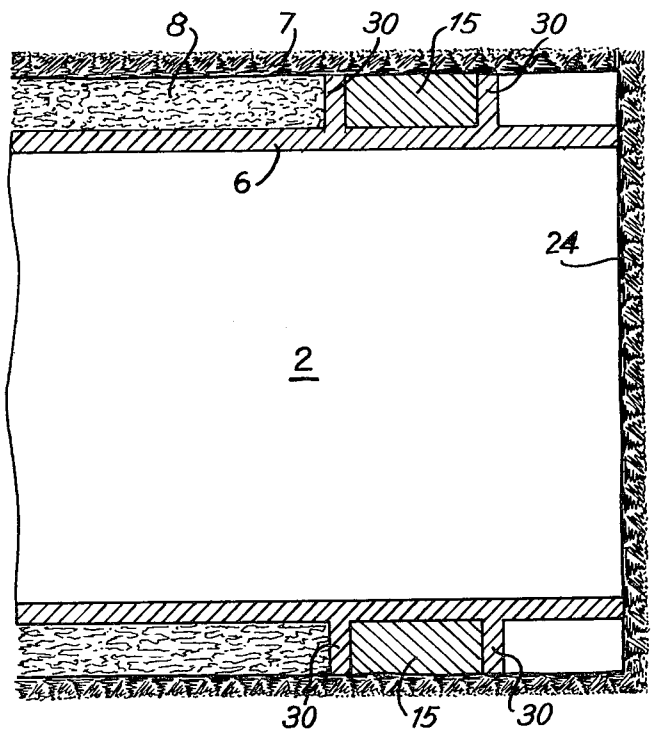
FIG. 4 is a view similar to FIG. 2 but showing another embodiment of the invention wherein no mud chamber is used at the excavating front.

An additional chamber 21 may be provided at the excavation front 24, such as clearly illustrated in FIGS. 1 and 2 of the drawings, in order to also contain drilling mud under a suitable pressure for preventing at least in part leakage from the annular chamber 8. This chamber 21 may be kept at a pressure sufficient to balance the pressure of the mud within chamber 8, in which case the use of the seal 15 at the end of the casing is avoided. Chamber 21 is built by including a plate 20 having the form of the cross-section of the excavation and attached to the innermost extremity of the casing 6. As the excavation is being effected by the use of a machine, the shaft 22 of motor 19 is passed through plate 20 through a suitable packing gland 28 in order to actuate a mechanical cutter 18 which is used to penetrate into the excavation front 24. Chamber 21 also serves as a deposit to receive the excavated material forming a thick slurry that may be pumped out from the tunnel by any suitable slurry pumping means (not shown). However, as it may be seen in schematical FIGS. 4 and 5, the excavation front 24 may not contain the pressure chamber 21, particularly when the excavation is effected by hand or, as an alternative, the excavation front may be partially open by the provision of a plate 29 having regulatable openings 28 so that the excavated material may enter into the casing 6 through the openings 28. In this latter cases, of course, the annular chamber 8 is maintained as much as possible under a leakproof condition by providing the seal 15 at the extremity of casing 6.

Figure 3:
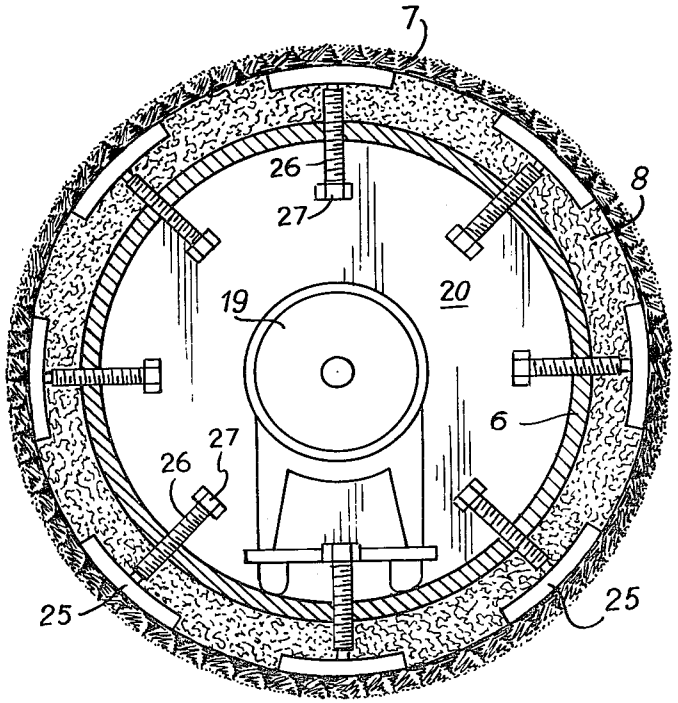
FIG. 3 is a diagrammatic fragmentary cross-sectional elevational view taken along lines 3—3 of FIG. 1 and looking in the direction of the arrows, in order to illustrate the supporting devices for maintaining the casing centered in the excavation.

The casing 6 is maintained centered within the excavation 2 by means of a number of supports clearly illustrated in FIG. 3 of the drawings and identified by the reference character 25. These supports may be controlled in order to vary the distance of the casing 6 from the walls of the excavation 2 by means of the threaded stems 26 and heads 27, which may be rotated to increase or decrease the spacing and to change the excentricity of the total assembly.

The supports 25, 26, 27 may also be raised or lowered or moved aside or they may be bent at the curves of the tunnel if sufficient flexibility is provided in casing 6.

The cross-section of the tunnel may have any shape, either circular, square, rectangular, elyptical, oval, or horseshoe shaped, etc., without therey requiring a change in the system used in accordance with the present invention.

The casing 6 may also be loaded to control flotation thereof during the process of insertion of said casing.

In order to regulate the mud pressure within the annular chamber 8, a plurality of gages 23 such as that illustrated in FIG. 2 of the drawings, may be connected through the wall of the casing 6, so as to measure the mud pressure and permit control thereof in accordance with the varying needs of the soil, particularly when the multiple seal embodiment illustrated in FIG. 1 of the drawings is used.

Casing 6, in accordance with the above, is generally formed by means of a plurality of prefabricated sections 5. Said sections 5 may have the form of precast lengths of concrete tube that may be manufactured in a plant or cast within the well. Said lengths may be thereafter joined by means of prestressing cables, rods, adhesives or any other fastening device in order to provide a monolithic and impermeable casing.

The seals used in accordance with the present invention are preferably provided using a pasty or plastic injectable material such as a putty or mastic, stored between a pair of flanges, and thus as it may be more clearly seen in FIGS. 1, 2, 4 and 5 of the drawings, the seal 15 provided at the inner end of the casing 6 may be formed by injecting a putty or mastic through a pipe 32 into a chamber formed between a flange 31 provided at the periphery of plate 20 and a flange 30 provided as an integral part of the corresponding tube section 5 of casing 6, whereas the intermediate seals 15 may be formed by injecting the sealing material through pipes such as 33 into chambers formed between a pair of spaced flanges 30 integrally formed in the casing 6. As the casing 6 is displaced inwardly of the excavation 2, some loss of the putty or mastic sealing material from the seals is experienced, but additional material may be injected through pipes 32 and 33 in order to replenish said losses and maintain a suitable pressure of the mastic or putty which will provide for a sufficient mud leakproof characteristic of the system of the present invention.

As to the seals such as seal 14 used at the entrance of the excavation tube, these seals must be such that they permit an absolute leakproof characteristic of chamber 8 and, thus, while the preferred embodiment of the invention is also to provide a seal operating on the basis of a plurality of chambers filled with a putty or mastic material, the structure of said seal must be quite different from the structure of the intermediate and the inner seals, whereby having reference to FIGS. 6 through 9 of the drawings, it will be seen that the outer seal 14 in accordance with a preferred embodiment of the invention is built such that a plurality of chambers 35 are arranged around the circumference formed by the outer surface of the casing 6, each said chamber 35 having a piston 36 actuated by means of a linear fluid motor 37 which controlledly presses against a body of plastic material such as the putty or mastic 38, the chambers 35 being supported by means of a suitable metallic structure 39 fastened to a cylindrical flange 40 which is attached to the casing 4 of the well 1. As the casing 6 is advanced inwardly of the excavation tube, some of the putty 38 is lost and therefore it must be replenished, for which purpose each one of the individual chambers 35 is provided with a feed pipe 41 to inject therethrough additional amounts of the mastic material to maintain a suitable pressure on the seal. Also, the linear motors or piston-cylinder assemblies 38, permit certain flexibility in view of the fact that the pressure may be maintained constant without feeding additional amounts of the mastic material for a certain time of operation, by merely pressing the mastic 38 with the piston 36 in order to compensate for the loss of material from the seal.

Figure 7:
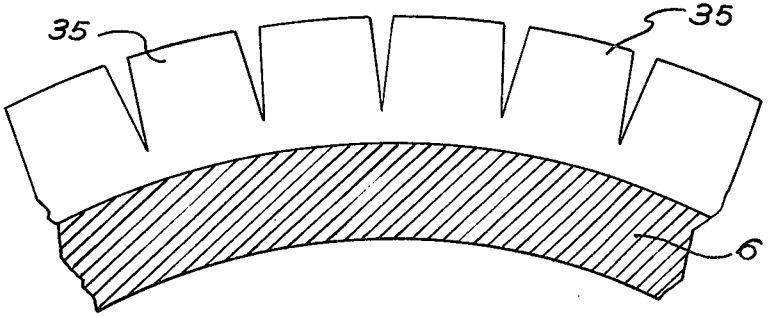
FIG. 7 is a diagrammatic cross-sectional view taken along lines 7—7 of FIG. 6 and looking in the direction of the arrows, in order to show the arrangement of the pressurizing chambers for the packing or stuffing material of the seal.
Figure 6:
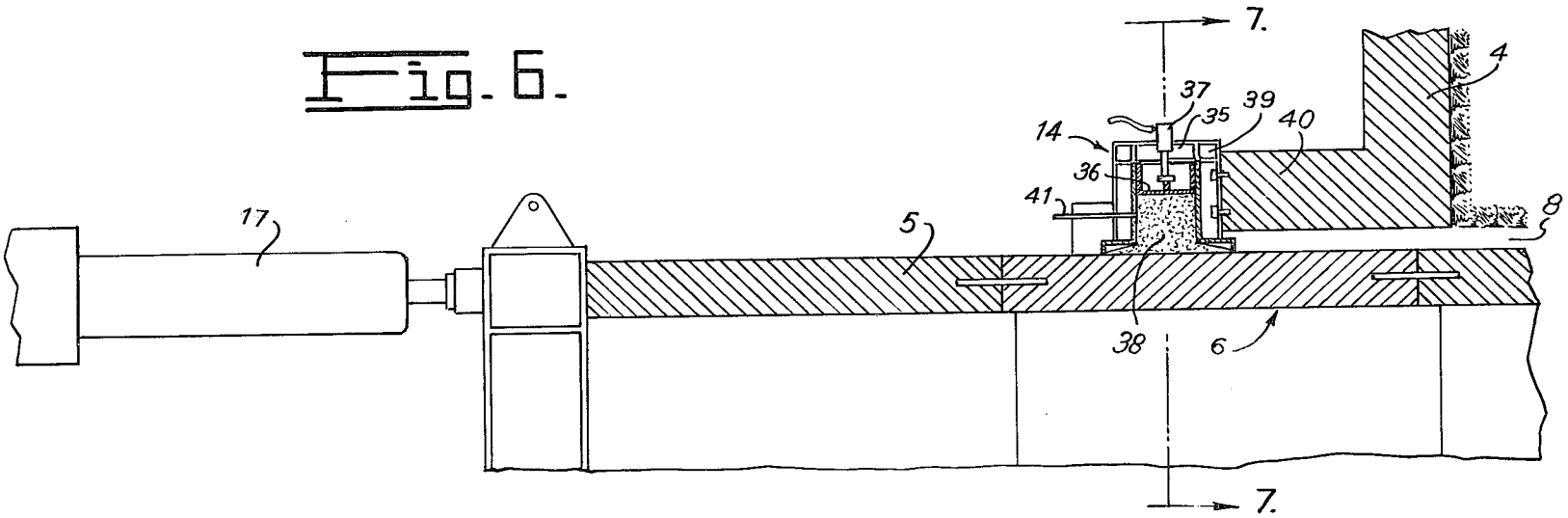
FIG. 6 is a fragmentary cross-sectional elevational view of the entrance section of the excavated tunnel and well, showing a preferred embodiment of a seal which is used to prevent leakage of the drilling mud out of the annular space between the casing and the walls of the excavation.

The individual chambers 35 are arranged around the circumference of the seal as clearly indicated in the diagrammatic representation of FIG. 7, in the manner of radial gear teeth, so that each individual pressurizing chamber 35 is arranged with its axis along a radius of the circumference having as its center the geometrical center of casing 6. Therefore, each individual piston 36 of each chamber 35 presses radially inwardly of the seal, so as to permit a uniform pressurization of the mastic material against the outer walls of the casing 6, whereby an absolutely leakproof joint is obtained.

Figure 8:
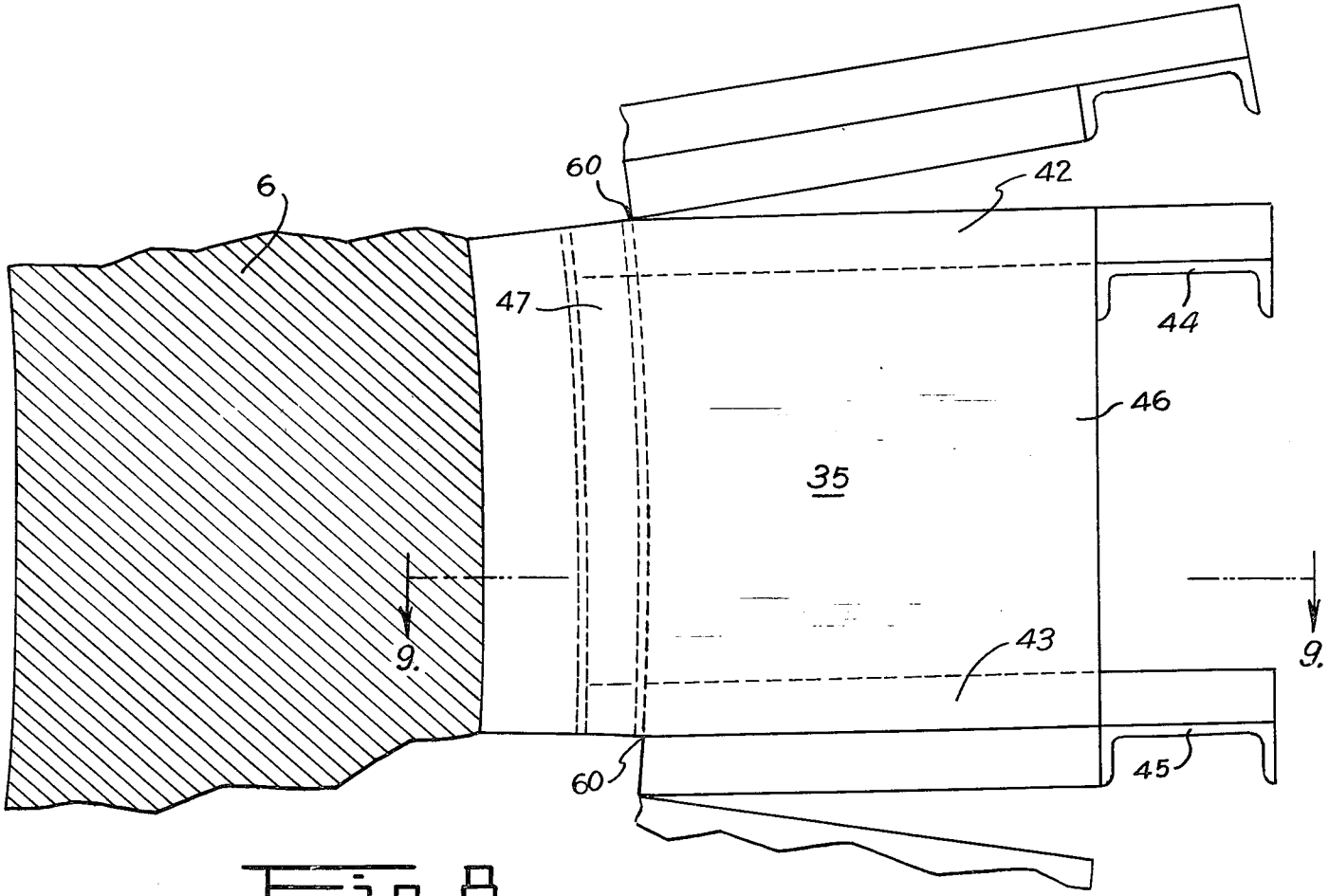
FIG. 8 is a cross-sectional detailed view of one of the individual pressurizing chambers of the seal illustrated in FIG. 7.
Figure 9:
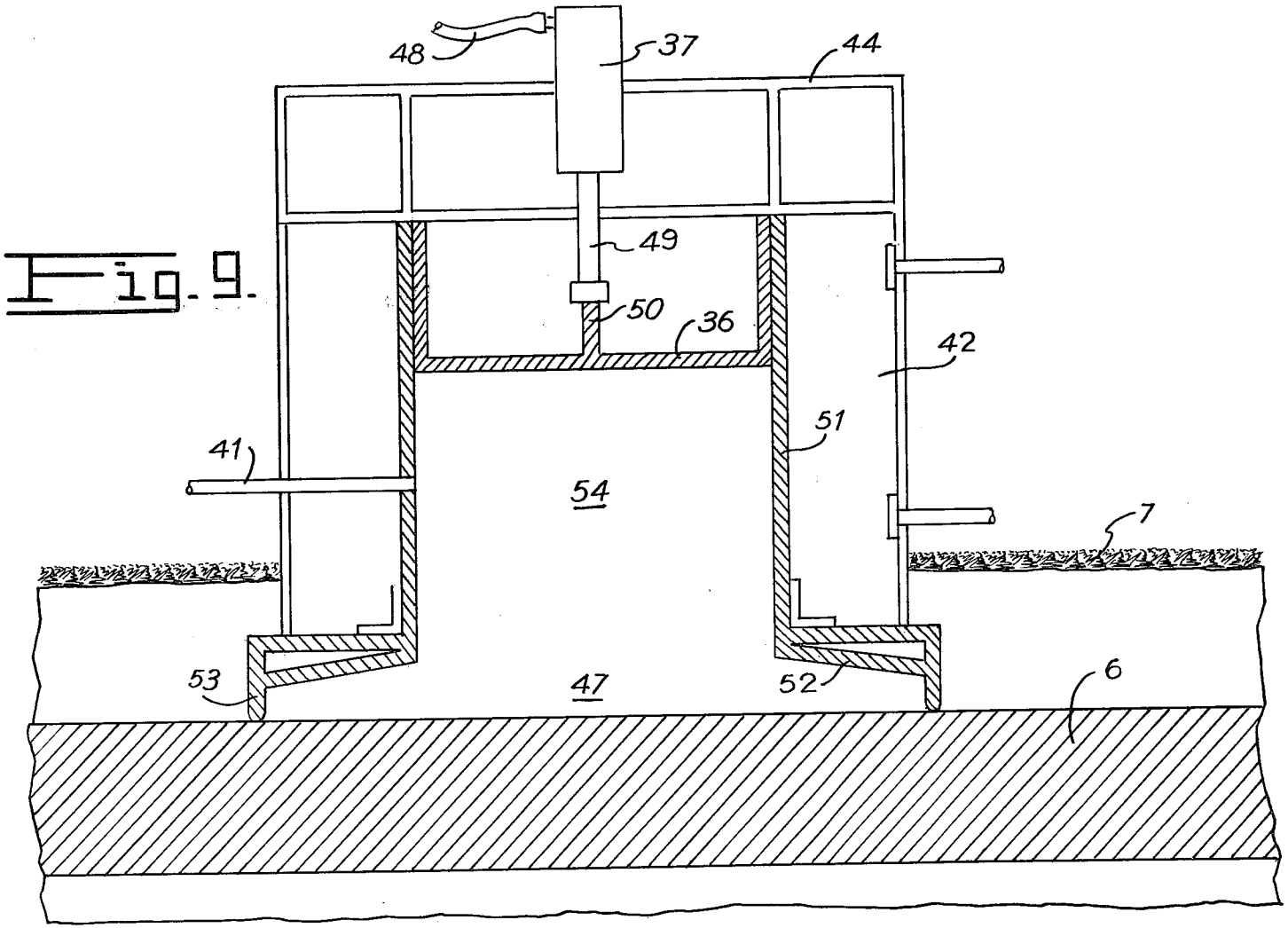
FIG. 9 is a cross-sectional view of one of the pressurizing chamber of the seal, taken along lines 9—9 of FIG. 8 and looking in the direction of the arrows.

FIGS. 8 and 9 illustrate in more detail the structure of each individual pressurizing chamber 35 and it will be seen that each individual chamber is formed by means of a pair of plates 42 and 43 which form a rectangular chamber 35. Each plate 42 and 43 is reinforced by means of U-shaped reinforcements 44 and 45 and a pair of annular plates such as 46 is arranged, one at each side of plates 42 and 43 of all the individual chambers, in order to close said chambers along their sides. Plates 42 and 43 of each adjacent chamber 35 join at a vertex which is separate from the outer surface of the casing 6 as clearly illustrated by the reference character 60 in FIG. 8 of the drawings, in order that a common annular continuous chamber 47 is formed at the bottom of the pressurizing chambers 35 to transmit a uniform pressure to the putty material in contact with the outer wall of casing 6.

Each individual chamber is provided, as more particularly illustrated in FIG. 9 of the drawings, and as mentioned above, with a pair of annular plates 46 and 51 which close the chambers along and throughout the circumference of the seal, and within each chamber a piston 36 is arranged having a pusher member 50 which is actuated by means of a piston rod 49 actuated in turn by the fluid operated cylinder 37 by means of the injection of fluid through a hose 48 or the like. The space 54 of each individual chamber 35 is filled with a putty or mastic material which flows down to the common annular chamber 47 which is bounded by means of an inclined annular wall 52 and a straight flange 53, thus forming a complete annular packing for the entrance of the chamber 8, around the casing 6 as mentioned above. By these means, coordinated actuation of the cylinders 37 will maintain the pressure of the putty or mastic material for a length of time and, when replenishment of the material becomes necessary, then additional material is injected through pipes or hoses such as 41, as more clearly illustrated in FIGS. 6 and 9 of the drawings.

From the above it will be seen that a simple process for excavating tunnels has been provided, in which the casing is fully spaced from the walls of the excavation, whereby the friction between the casing 6 and the soil 7 is practically eliminated, inasmuch as casing 6 is floating on a drilling mud contained in chamber 8. Therefore, very long casings 6 may be advanced inwardly of the excavation 2 with minimum efforts on the material forming the casing. In the process in accordance with the present invention, the drilling mud is used as a flotation medium for the casing and also as a supporting element for the soil and not merely as a lubricating agent as was the case of the prior art lubricated push-casing method, whereby it constitutes a remarkable improvement over said prior art, inasmuch as in the known method the casing is directly supported on the soil, regardless of the fact that a certain lubricating agent is injected to reduce the friction forces. Said prior art lubricating agent, on the other hand, is generally a drilling mud of a very thick consistency, such as a concentrated bentonite type mud, which renders handling thereof very difficult, whereas in accordance with the present invention the floating muds may be prepared with a much more fluid consistency, in view of the fact that they are to serve merely as a floating medium, with the consequent advantages in the handling thereof.

As there is practically no friction between the soil and the wall of the casing when the method of the present invention is used, the thrust necessary to inwardly displace the casing is relatively small, whereby the jacks 17 may be regulated to merely compensate for the displacement of the excavation front in the tunnel in accordance with the excavation process and with the pressures exerted by the soil, without the need of providing for overcoming any measurable friction stress.

It will be clearly apparent to anyone skilled in the art that the gap occupied by the mud may have any dimension, that is, from a few inches up to several feet if necessary, in order to provide for curvatures in the tunnel or in order to correct alignments. It will also be apparent that it is possible to temporarily shore the interior of the casing 6 when very high mud pressures need to be handled.

The process of the present invention is completed by injection into chamber 8 previously filled with the drilling mud and once the required length of the casing has been introduced into the excavation, of mortars, concretes, soils, cements and the like, in order to suitably and permanently support and join the walls of the excavation 2 with the walls of the casing 6, whereby this method of injection prevents any subsidence, because no void is ever left and because the mortar, when injected, will displace the mud from chamber 8 instantaneously taking its place, whereby the excavation made through the soil 7 will be preserved unaltered.

It will be seen from the above that for the first time an excavation method has been provided which, by means of the simple injection of drilling muds into an annular chamber between the casing and the inner surface of the excavation, floats said casing avoiding all types of friction stresses, whereby the introduction of a fully completed and prefabricated casing inwardly of a horizontal or inclined excavation is possible if desired, regardless of the fact that said excavation may have a straight or curved shape, while the excavation walls are at the same time supported by said drilling mud, thus maintaining atmospheric pressure in the interior of the casing which permits free access to workers. Also, the system of the present invention avoids the carrying of concrete or additional materials inwardly of the tunnel, inasmuch as the casing sections may be prefabricated outside the tunnel and therefore may undergo a perfect inspection prior to their installation. Also, the method of the present invention permits the injection of mortars to fill the space originally occupied by the mud, with the latter being displaced by the former whereby collapsing of the walls of the excavation is prevented, because no single part of the excavation is ever left without support.

Although I have shown and described certain specific embodiments of the invention, I am fully aware that many modifications thereof are possible. The invention, therefore, is not to be restricted except insofar as is necessitated by the prior art and by the spirit of the appended claims.

What is claimed is:

1. A method of excavating tunnels wherein a casing is gradually pushed inwardly of the excavation as the excavation front advances, which comprises the steps of excavating a tunnel having a cross-sectional area larger than the outer cross-sectional area of the casing;

placing the casing concentrically of the excavation at the open mouth thereof to be pushed inwardly of said excavation to thereby leave an annular chamber between the outer wall of the casing and the surface of the excavation;

gradually pushing the casing inwardly of the excavation as the excavation front advances;

placing at least a seal between the outer wall of the casing and the wall of the excavation at the innermost end of the casing and another seal between the outer wall of the casing and the wall of the excavation at the mouth of said excavation in order to form a closed annular chamber;

injecting a sufficient amount of drilling fluid under pressure into said chamber such that the casing is floated in said drilling fluid and the walls of the excavation will be spaced from the wall of the casing by a thick layer of said fluid thus eliminating friction stresses between the casing and the excavation;

and then continue to push the casing inwardly of the excavation while maintaining the pressure of the fluid in said chamber as the excavation front advances.

2. A method of excavating tunnels according to claim 1 wherein said innermost seal is provided by attaching a plate having a cross-sectional area approximately equal to the cross sectional area of the excavation, to the innermost end of said casing, thus forming an additional chamber between said plate and the excavation front, and injecting a drilling fluid into said additional chamber under a pressure approximately equivalent to the pressure of the mud in said annular chamber to thereby prevent leakage of drilling fluid therefrom and provide a means for pumping out the excavated material.

3. A method of excavating tunnels according to claim 1 wherein a plurality of intermediate seals are provided along the length of the tunnel in order to form separate annular chambers for containing drilling fluid under pressure, so as to enable independent control of the drilling fluid pressure along the length of the excavation.

4. A method of excavating tunnels according to claim 3 wherein said inner and intermediate seals are formed by providing peripheral cavities by arranging a pair of flanges integrally formed on the outer surface of the casing, with the peripheries thereof nearly abutting against the wall of the excavation, and injecting a putty-like mastic sealing material into the cavities thus formed whereby to fill the irregularities at the gap between the peripheries of said flanges and the wall of the excavation.

5. A method of excavating tunnels according to claim 4 wherein the seal at the mouth of the excavation is formed by providing a pair of annular plates around the casing, one of said annular plates being fastened to said mouth in a leak proof arrangement and the other being supported by a plurality of longitudinally extending plates extending between both annular plates and fastened thereto, said longitudinally extending plates being arranged by pairs around said casing and their inner ends terminating at a distance from the outer surface of said casing, forming a vertex between each pair of adjacent plates and a chamber between the alternate pair of adjacent plates, thus providing a plurality of radially extending chambers around the casing, communicated by an annular chamber directly contacting the outer surface of the casing, each said radially extending chamber and said annular chamber being filled with a putty-like mastic material and each radial chamber having a piston and cylinder assembly operable to maintain the pressure therein by displacing said piston towards the center of said casing as mastic material is lost by carrying it over with the moving casing, and replenishing said mastic material whenever necessary through injection thereof into said radially extending chambers.

6. A method of excavating tunnels according to claim 1 wherein said casing is centered within the excavation by providing a plurality of adjustable supports which are arranged in at least one circumferential array, each said support having a bearing plate in contact with the wall of the excavation and a movable stem capable of displacing said bearing plate radially inwardly and outwardly of the casing.

* * * * *